US008257463B2

(12) United States Patent
Fife et al.

(10) Patent No.: US 8,257,463 B2
(45) Date of Patent: Sep. 4, 2012

(54) CAPACITOR ANODE FORMED FROM FLAKE POWDER

(75) Inventors: James Allen Fife, Myrtle Beach, SC (US); Zebbie Lynn Sebald, Myrtle Beach, SC (US)

(73) Assignee: AVX Corporation, Myrtle Beach, SC (US)

( * ) Notice: Subject to any disclaimer, the term of this patent is extended or adjusted under 35 U.S.C. 154(b) by 607 days.

(21) Appl. No.: 11/338,606

(22) Filed: Jan. 23, 2006

(65) Prior Publication Data

US 2007/0172377 A1 Jul. 26, 2007

(51) Int. Cl.
*B22F 1/00* (2006.01)
*B22F 1/02* (2006.01)
*C22C 1/05* (2006.01)

(52) U.S. Cl. ..... 75/255; 361/529; 204/292

(58) Field of Classification Search ..... 75/255; 361/529; 204/292
See application file for complete search history.

(56) References Cited

U.S. PATENT DOCUMENTS

| | | | | |
|---|---|---|---|---|
| 3,647,415 | A | | 3/1972 | Yano et al. |
| 3,779,717 | A | | 12/1973 | Gustison |
| 3,934,179 | A | | 1/1976 | Pierret |
| 4,059,887 | A | | 11/1977 | Galvagni |
| 4,085,435 | A | | 4/1978 | Galvagni |
| 4,149,876 | A | | 4/1979 | Rerat |
| 4,441,927 | A | | 4/1984 | Getz et al. |
| 4,555,268 | A | | 11/1985 | Getz |
| 4,574,333 | A | | 3/1986 | Snyder |
| 4,609,971 | A | * | 9/1986 | Shaffer ..... 361/525 |
| 4,684,399 | A | | 8/1987 | Bergman et al. |
| 4,940,490 | A | | 7/1990 | Fife et al. |
| 4,945,452 | A | * | 7/1990 | Sturmer et al. ..... 361/529 |
| 4,960,471 | A | | 10/1990 | Fife et al. |
| 4,984,134 | A | | 1/1991 | Locke |
| 5,099,218 | A | | 3/1992 | Salisbury |
| 5,166,656 | A | | 11/1992 | Badihi et al. |
| 5,198,968 | A | | 3/1993 | Galvagni |
| 5,211,741 | A | | 5/1993 | Fife |
| 5,217,526 | A | | 6/1993 | Fife |
| 5,228,188 | A | | 7/1993 | Badihi et al. |
| 5,232,169 | A | | 8/1993 | Kaneko et al. |
| 5,242,481 | A | | 9/1993 | Kumar |
| 5,245,514 | A | | 9/1993 | Fife et al. |
| 5,261,942 | A | | 11/1993 | Fife et al. |
| 5,296,833 | A | | 3/1994 | Breen et al. |
| 5,306,462 | A | | 4/1994 | Fife |
| 5,357,399 | A | | 10/1994 | Salisbury |
| 5,394,295 | A | | 2/1995 | Galvagni et al. |
| 5,442,978 | A | | 8/1995 | Hildreth et al. |

(Continued)

OTHER PUBLICATIONS

Article—*Adsorpotion of Gases in Multimolecular Layers*, Brunauer et al., The Journal of the American Chemical Society, vol. 60, Jan.-Jun. 1938, pp. 309-319.

(Continued)

*Primary Examiner* — Emily Le
*Assistant Examiner* — Weiping Zhu
(74) *Attorney, Agent, or Firm* — Dority & Manning, P.A.

(57) ABSTRACT

A capacitor anode that is formed from flake powder is provided. The anodes are formed from low density flake powder (e.g., relatively large in size), which is believed to provide a short transmission line between the outer surface and interior of the anode. This may result in a low equivalent series resistance ("ESR") and improved volumetric efficiency for capacitors made from such anodes.

13 Claims, 8 Drawing Sheets

U.S. PATENT DOCUMENTS

| | | | |
|---|---|---|---|
| 5,448,447 | A | 9/1995 | Chang |
| 5,457,862 | A | 10/1995 | Sakata et al. |
| 5,473,503 | A | 12/1995 | Sakata et al. |
| 5,486,977 | A | 1/1996 | Hasegawa |
| 5,495,386 | A | 2/1996 | Kulkarni |
| 5,522,558 | A | 6/1996 | Kaneko |
| 5,548,474 | A | 8/1996 | Chen et al. |
| 5,580,367 | A | 12/1996 | Fife |
| 5,580,516 | A | 12/1996 | Kumar |
| 5,643,432 | A | 7/1997 | Qiu |
| 5,729,428 | A | 3/1998 | Sakata et al. |
| 5,812,367 | A | 9/1998 | Kudoh et al. |
| 5,949,639 | A | 9/1999 | Maeda et al. |
| 6,126,097 | A | 10/2000 | Chen et al. |
| 6,139,593 | A | 10/2000 | Kono |
| 6,145,765 | A | 11/2000 | Capelle, Jr. et al. |
| 6,165,623 | A | 12/2000 | Fife et al. |
| 6,197,252 | B1 | 3/2001 | Bishop et al. |
| 6,240,043 | B1 | 5/2001 | Hanson et al. |
| 6,272,003 | B1 | 8/2001 | Schaper |
| 6,285,542 | B1 | 9/2001 | Kennedy, III et al. |
| 6,322,912 | B1 | 11/2001 | Fife |
| 6,348,113 | B1 | 2/2002 | Michaluk et al. |
| 6,350,406 | B1 | 2/2002 | Satou et al. |
| 6,375,704 | B1 | 4/2002 | Habecker et al. |
| 6,396,292 | B2 | 5/2002 | Hembree et al. |
| 6,402,066 | B1 | 6/2002 | Habecker et al. |
| 6,452,777 | B1 | 9/2002 | Naito |
| 6,462,507 | B2 | 10/2002 | Fisher, Jr. |
| 6,611,421 | B2 | 8/2003 | Meadows et al. |
| 6,643,121 | B1 | 11/2003 | Huntington |
| 6,673,389 | B1 | 1/2004 | Huntington |
| 6,674,635 | B1 | 1/2004 | Fife et al. |
| 6,689,187 | B2 | 2/2004 | Oda |
| 6,699,767 | B1 | 3/2004 | Huntington |
| 6,751,082 | B2 | 6/2004 | Devoe et al. |
| 6,751,085 | B1 | 6/2004 | Huntington |
| 6,753,218 | B2 | 6/2004 | Devoe et al. |
| 6,757,152 | B2 | 6/2004 | Galvagni et al. |
| 6,764,446 | B2 | 7/2004 | Wolinsky et al. |
| 6,813,140 | B1 | 11/2004 | Huntington |
| 6,849,292 | B1 | 2/2005 | Huntington |
| 6,870,727 | B2 | 3/2005 | Edson et al. |
| 6,927,967 | B2 | 8/2005 | Tripp |
| 7,005,722 | B2 | 2/2006 | Schaper et al. |
| 7,054,136 | B2 | 5/2006 | Ritter et al. |
| 7,056,357 | B2 | 6/2006 | Kuriyama |
| 7,057,878 | B2 | 6/2006 | Vierow et al. |
| 2002/0027763 | A1 | 3/2002 | Schaper |
| 2002/0177782 | A1 | 11/2002 | Penner |
| 2003/0076695 | A1 | 4/2003 | Grant et al. |
| 2003/0084360 | A1 | 5/2003 | Grant et al. |
| 2004/0016094 | A1 | 1/2004 | Schaper |
| 2004/0057192 | A1 | 3/2004 | Galvagni et al. |
| 2005/0122663 | A1 | 6/2005 | Poltorak |

OTHER PUBLICATIONS

Paper from AVX Ltd., Tantalum Division entitled *Basic Tantalum Capacitor Technology* by John Gill, 1995, 7 pages.

Paper entitled *A Novel Substrate for Solid Electrolytic Capacitors* by Qiu et al., presented at the CARTS Conference on Mar. 21, 2001 (2001, Edit. 21, pp. 99-103), 5 pages.

Paper entitled *Tantalum Nitride: A New Substrate for Solid Electrolytic Capacitors* by T. Tripp; Proceedings of CARTS 2000: 20$^{th}$ Capacitor and Resistor Technology Symposium, Mar. 6-20, 2000.

* cited by examiner

CAPACITOR ANODE FORMED FROM FLAKE POWDER

BACKGROUND OF THE INVENTION

Solid electrolytic capacitors (e.g., tantalum or niobium capacitors) have been a major contributor to the miniaturization of electronic circuits and have made possible the application of such circuits in extreme environments. Tantalum capacitors, for example, are typically made by compressing tantalum powder into a pellet, sintering the pellet to form a porous body, and then subjecting it to anodization to form a continuous dielectric oxide film on the sintered body. The capacitance of the tantalum anode is a direct function of the specific surface area of the sintered powder. Greater specific surface area may be achieved, of course, by increasing the grams of powder per pellet, but cost considerations have dictated that development be focused on means to increase the specific surface area per gram of powder utilized. Because decreasing the particle size of the tantalum powder produces more specific surface area per unit of weight, effort has been extended into ways of making the tantalum particles smaller without introducing other adverse characteristics that often accompany size reduction.

One technique employed for increasing the specific surface area of tantalum powder involves flattening the powder particles into a flake shape. For example, U.S. Pat. No. 4,940,490 to Fife, et al. is directed to a flaked tantalum powder prepared by deforming or flattening a granular tantalum powder, followed by a size reduction step until a Scott density greater than about 18 g/in$^3$ is achieved. Preferably, this size reduction process is aided by embrittling the flake by techniques such as hydriding, oxidizing, cooling to low temperatures, etc., to enhance breakage when reducing the flake particle size by mechanical means such as crushing, or other size reduction processes. Unfortunately, the technique of the '490 patent is relatively cost prohibitive and inefficient in that the powder is subjected to multiple complex processing steps before it may be used to form a capacitor anode.

As such, a need currently exists for a more efficient and cost effective technique of forming a capacitor anode from flake particles.

SUMMARY OF THE INVENTION

In accordance with one embodiment of the present invention, a method for forming a pressed pellet for use in a capacitor anode is disclosed. The method comprises embedding into a flake powder a wire that defines a longitudinal axis. The flake powder comprises a valve-action metal and has a bulk density of from about 0.1 to about 0.8 grams per cubic centimeter. The method also comprises compacting the powder in a direction that is substantially perpendicular to the longitudinal axis of the wire.

In accordance with another embodiment of the present invention, an electrolytic capacitor is disclosed that comprises an anode. The anode is formed from a tantalum flake powder having a bulk density of from about 0.1 to about 0.8 grams per cubic centimeter, a specific surface area of from about 0.5 to about 10 meters squared per gram, and an aspect ratio of from about 2 to about 400.

Other features and aspects of the present invention are set forth in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which:

FIG. 1 is a schematic illustration of one embodiment of the present invention for pressing a flake tantalum powder into a pellet, in which

Figure 1A:
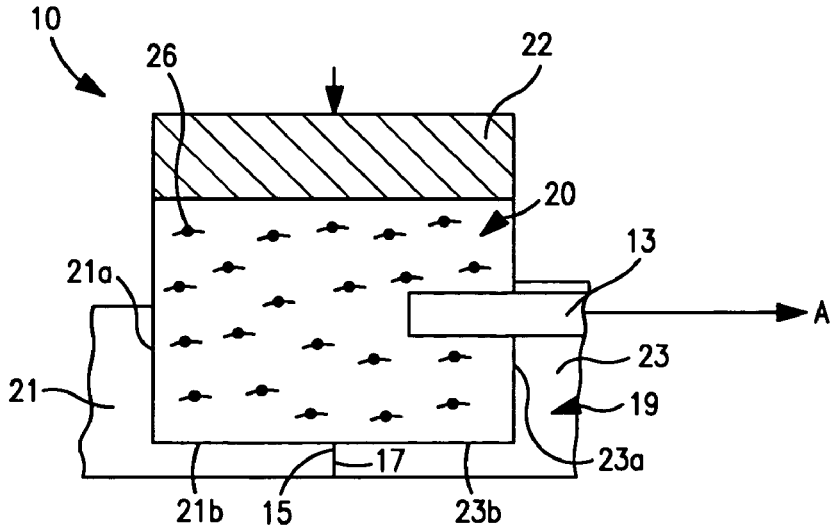
FIG. 1A illustrates the press mold prior to compaction and FIG. 1B illustrates the press mold after compaction.

Repeat use of references characters in the present specification and drawings is intended to represent same or analogous features or elements of the invention.

DETAILED DESCRIPTION OF REPRESENTATIVE EMBODIMENTS

It is to be understood by one of ordinary skill in the art that the present discussion is a description of exemplary embodiments only, and is not intended as limiting the broader aspects of the present invention, which broader aspects are embodied in the exemplary construction.

Generally speaking, the present invention is directed to an anode and capacitor made therefrom. In contrast to conventional techniques, the anodes of the present invention are formed from low density flake powder (e.g., powder composed of flakes that are relatively large in size), which is believed to provide a short transmission line between the outer surface and interior of the anode. This may result in a low equivalent series resistance ("ESR") and improved volumetric efficiency for capacitors made from such anodes. The ability to form such improved anodes and capacitors depends in part on the nature of the manner in which the anodes are formed. Specifically, the anodes are formed from a powder constituted primarily by a valve metal or from a composition that contains the valve metal as a component. Suitable valve metals that may be used include, but are not limited to, tantalum, niobium, aluminum, hafnium, titanium, alloys of these metals, and so forth. For example, powder may be formed from a valve metal oxide or nitride (e.g., niobium oxide (e.g., NbO), tantalum oxide, tantalum nitride, niobium nitride, etc.) that is generally considered a semi-conductive or highly conductive material. Examples of such valve metal oxides are described in U.S. Pat. No. 6,322,912 to Fife, which is incorporated herein in its entirety by reference thereto for all purposes. Examples of such valve metal nitrides are described in "Tantalum Nitride: A New Substrate for Solid Electrolytic Capacitors" by T. Tripp; Proceedings of CARTS 2000: 20th Capacitor and Resistor Technology Symposium, 6-20 Mar. 2000.

The valve metals are typically extracted from their ores and formed into powders by processes that include chemical reduction. For instance, valve metals (e.g., tantalum) may be prepared by reducing a valve metal salt with a reducing agent. The reducing agent may be hydrogen, active metals (e.g., sodium, potassium, magnesium, calcium, etc.), and so forth. Likewise, suitable valve metal salts may include potassium fluotantalate ($K_2TaF_7$), sodium fluotantalate ($Na_2TaF_7$), tantalum pentachloride ($TaCl_5$), etc. Examples of such reduction techniques are described in U.S. Pat. Nos. 3,647,415 to Yano, et al.; 4,149,876 to Rerat; 4,684,399 to Bergman, et al.; and 5,442,978 to Hildreth, et al., which are incorporated herein in their entirety by reference thereto for all purposes. For instance, a valve metal salt may be electrolytically reduced in a molten bath with a diluent alkali metal halide salt (e.g., KCl or NaCl). The addition of such diluents salts allows the use of lower bath temperatures. Valve metal powder may also be made by an exothermic reaction in a closed vessel in which the valve metal salt is arranged in alternate layers with the reducing agent. The enclosed charge is indirectly heated until the exothermic reaction is spontaneously initiated.

Regardless of the manner in which it is formed, the resulting powder may be a flake-type powder in that it possesses a relatively flat or platelet shape. Alternatively, the flake-type powder may be achieved through mechanical deformation of the raw powder. One benefit of such flake particles is that they may better withstand the high sintering temperatures and prolonged sintering times needed to form effective anodes, and also produce a porous sintered body with low shrinkage and a large specific surface area. Some examples of flake tantalum powders are described in U.S. Pat. Nos. 6,348,113 B1; 5,580,367; 5,580,516; 5,448,447; 5,261,942; 5,242,481; 5,211,741; 4,940,490; and 4,441,927, which are incorporated herein in their entirety by reference thereto for all purposes. Examples of flake niobium powders are described in U.S. Pat. Nos. 6,420,043 B1; 6,402,066 B1; 6,375,704 B1; and 6,165,623, which are incorporated herein in their entirety by reference thereto for all purposes. Other metal flakes, methods for making metal flakes, and uses for metal flakes are described in U.S. Pat. Nos. 4,684,399; 5,261,942; 5,211,741; 4,940,490; 5,448,447; 5,580,516; 5,580,367; 3,779,717; 4,441,927; 4,555,268; 5,217,526; 5,306,462; 5,242,481; and 5,245,514, which are incorporated herein in their entirety by reference thereto for all purposes.

The properties of the flake powder employed in the present invention are selectively varied to achieve a capacitor anode having improved characteristics. The charge capability (C*V) of a valve metal capacitor (typically measured as microfarad-volts), for instance, is directly related to the total surface area of the anode after sintering and anodization. Capacitors having high surface area anodes are desirable because the greater the surface area, the greater the charge capacity of the capacitor. Greater net surface area may be achieved by increasing the quantity (grams) of powder per pellet. One way to accomplish this is by increasing the specific surface area (e.g., surface area per gram) of the flake powder. The capacitance values are typically measured based upon the volume of pellet produced, i.e., volumetric efficiency, which is defined as the product of capacitance ("C") and working voltage ("V"), divided by the volume of the capacitor (cubic centimeters). By using high specific surface area powders, capacitor sizes may be reduced at the same level of CV or a larger CV may be achieved for a given capacitor size.

One method for increasing the specific surface area of a flake powder is to reduce its thickness. This may be accomplished in a variety of ways, including subjecting the powder to a mechanical milling process that grinds the flake particles into a smaller size. Any of a variety of milling techniques may be utilized in the present invention to achieve the desired particle characteristics. For example, the powder may be dispersed in a fluid medium (e.g., ethanol, methanol, fluorinated fluid, etc.) to form a slurry. The slurry may then be combined with a grinding media (e.g., metal balls, such as tantalum) in a mill. The number of grinding media may generally vary depending on the size of the mill, such as from about 100 to about 2000, and in some embodiments from about 600 to about 1000. The starting powder, the fluid medium, and grinding media may be combined in any proportion. For example, the ratio of the starting valve metal powder to the grinding media may be from about 1:5 to about 1:50. Likewise, the ratio of the volume of the fluid medium to the combined volume of the starting valve metal powder may be from about 0.5:1 to about 3:1, in some embodiments from about 0.5:1 to about 2:1, and in some embodiments, from about 0.5:1 to about 1:1. Some examples of mills that may be used in the present invention are described in U.S. Pat. Nos. 5,522,558; 5,232,169; 6,126,097; and 6,145,765, which are incorporated herein in their entirety by reference thereto for all purposes.

Milling may occur for any predetermined amount of time needed to achieve the target specific surface area. For example, the milling time may range from about 30 minutes to about 40 hours, in some embodiments, from about 1 hour to about 20 hours, and in some embodiments, from about 5 hours to about 15 hours. Milling may be conducted at any desired temperature, including at room temperature or an elevated temperature. After milling, the fluid medium may be separated or removed from the powder, such as by air-drying, heating, filtering, evaporating, etc. For instance, the flake powder may optionally be subjected to one or more acid leaching steps to remove metallic impurities. Such acid leaching steps are well known in the art and may employ any of a variety of acids, such as mineral acids (e.g., hydrochloric acid, hydrobromic acid, hydrofluoric acid, phosphoric acid, sulfuric acid, nitric acid, etc.), organic acids (e.g., citric acid, tartaric acid, formic acid, oxalic acid, benzoic acid, malonic acid, succinic acid, adipic acid, phthalic acid, etc.); and so forth.

The greater the amount of energy or impact imparted by the milling process, the higher the resultant specific surface area and the lower the bulk density. However, the increase in specific surface area and reduction in density is not without limit. That is, too great of an increase in specific surface area and/or reduction in bulk density may adversely increase processing efficiency and costs. Thus, the powder is milled to an extent that it possesses a specific surface area of from about 0.5 to about 10.0 $m^2/g$, in some embodiments from about 0.7 to about 5.0 $m^2/g$, and in some embodiments, from about 2.0 to about 4.0 $m^2/g$. Likewise, the resultant bulk density is typically from about 0.1 to about 0.8 grams per cubic centimeter ($g/cm^3$), in some embodiments from about 0.2 to about 0.6 $g/cm^3$, and in some embodiments, from about 0.3 to about 0.5 $g/cm^3$. The milled powder also typically has a screen size distribution of at least about 60 mesh, in some embodiments from about 60 to about 325 mesh, and in some embodiments, from about 100 to about 200 mesh.

Although not required, the flaked tantalum powder may be agglomerated using any technique known in the art. Typical agglomeration techniques involve, for instance, one or multiple heat treatment steps in a vacuum or inert atmosphere at temperatures ranging from about 800° C. to about 1400° C. for a total time period of from about 30 to about 60 minutes. If desired, the flake powder may also be doped with sinter retardants in the presence of a dopant, such as aqueous acids (e.g., phosphoric acid). The amount of the dopant added depends in part on the surface area of the powder, but is typically present in an amount of no more than about 200 parts per million ("ppm"). The dopant may be added prior to, during, and/or subsequent to the heat treatment step(s).

The flake powder may also be subjected to one or more deoxidation treatments to improve the ductility of the powder and reduce leakage current in the anodes. For example, the flake powder may be exposed to a getter material (e.g., magnesium), such as described in U.S. Pat. No. 4,960,471, which is incorporated herein in its entirety by reference thereto for all purposes. The getter material may be present in an amount of from about 2% to about 6% by weight of the powder. The temperature at which deoxidation occurs may vary, but typically ranges from about 700° C. to about 1600° C., in some embodiments from about 750° C. to about 1200° C., and in some embodiments, from about 800° C. to about 1000° C. The total time of the deoxidation treatment(s) may range from about 20 minutes to about 3 hours. Deoxidation also preferably occurs in an inert atmosphere (e.g., argon). Upon completion of the deoxidation treatment(s), the magnesium or other getter material typically vaporizes and forms a precipitate on the cold wall of the furnace. To ensure removal of the getter material, however, the powder may be subjected to one or more acid leaching steps, such as with nitric acid, hydrofluoric acid, etc.

Regardless of the particular method employed, the resulting flake powder has certain characteristics that enhance its ability to be formed into a capacitor anode. For example, the flake powder has a specific surface area of from about 0.5 to about 10.0 $m^2/g$, in some embodiments from about 0.7 to about 5.0 $m^2/g$, and in some embodiments, from about 2.0 to about 4.0 $m^2/g$. Likewise, the resultant bulk density is typically from about 0.1 to about 0.8 grams per cubic centimeter ($g/cm^3$), in some embodiments from about 0.2 to about 0.6 $g/cm^3$, and in some embodiments, from about 0.4 to about 0.6 $g/cm^3$.

The flake powder is also a high grade, high purity powder, having a purity level greater than about 90 wt. %, in some embodiments greater than about 95 wt. %, and in some embodiments, greater than about 98 wt. %. The degree of flatness of the powder is generally defined by the "aspect ratio", i.e., the diameter or width of the particles divided by the thickness ("D/T"). That is, flat particles will have an aspect ratio that is higher than spherical particles. The powder used in the present invention typically has an aspect ratio of from about 2 to about 400, in some embodiments from about 5 to 350, and in some embodiments, from about 10 to about 300. The powder may also be hydrided or non-hydrided.

Once the flake powder is formed, it is then optionally mixed with a binder and/or lubricant to ensure that the particles adequately adhere to each other when pressed to form the anode. For example, binders commonly employed for tantalum powder have included camphor, stearic and other soapy fatty acids, Carbowax (Union Carbide), Glyptal (General Electric), polyvinyl alcohols, napthaline, vegetable wax, and microwaxes (purified paraffins). The binder is dissolved and dispersed in a solvent. Exemplary solvents may include acetone; methyl isobutyl ketone; trichloromethane; fluorinated hydrocarbons (freon) (DuPont); alcohols; and chlorinated hydrocarbons (carbon tetrachloride). When utilized, the percentage of binders and/or lubricants may vary from about 0.1% to about 4% by weight of the total mass. It should be understood, however, that binders and lubricants are not required in the present invention. In fact, due to the low bulk density of the flake powder, the present inventors have discovered that certain pressing techniques may be employed that do not require the use of such binders or lubricants.

Once formed, the flake powder is compacted in accordance with the present invention. Any of a variety of powder press molds may be employed in the present invention. For example, the press mold may be a single station compaction press using a die and one or multiple punches. Alternatively, anvil-type compaction press molds may be used that use only a die and single lower punch. Single station compaction press molds are available in several basic types, such as cam, toggle/knuckle and eccentric/crank presses with varying capabilities, such as single action, double action, floating die, movable platen, opposed ram, screw, impact, hot pressing, coining or sizing.

Referring to FIG. 1, for example, one embodiment of the present invention for compacting flake powder into the shape of an anode using a single station press mold 10 will now be described in more detail. In this particular embodiment, the single station press mold 10 includes a die 19 having a first die portion 21 and a second die portion 23. Of course, the die 19 may also be formed from a single part instead of multiple portions. Nevertheless, in FIG. 1, the first die portion 21 defines inner walls 21*a* and 21*b*, and the second die portion defines inner walls 23*a* and 23*b*. The walls 21*a* and 23*a* are substantially perpendicular to the walls 23*a* and 23*b*, respectively. The first and second die portions 21 and 23 also define opposing surfaces 15 and 17. During use, the surfaces 15 and 17 are placed adjacent to each other so that the walls 21*b* and 23*b* are substantially aligned to form a die cavity 20 having a rectangular pellet shape. It will be appreciated that while a single die cavity is schematically shown in FIG. 1, multiple die cavities may be employed. As shown in FIG. 1A, a certain quantity of flake powder 26 is loaded into the die cavity 20 and an anode wire 13 (e.g., tantalum wire) is embedded therein. Although shown in this embodiment as having a cylindrical shape, it should be understood that any other shape, such as rectangular, square, etc., may also be utilized for the anode wire 13. Further, the anode wire 13 may also be attached (e.g., welded) to the anode subsequent to pressing and/or sintering. Typically, the die cavity 20 is capable of holding from about 5 to about 50 times the volume of the resulting anode. In contrast, conventional techniques are limited to a die cavity 20 volume of approximately 3 to 4 times the volume of the anode.

Figure 1B:
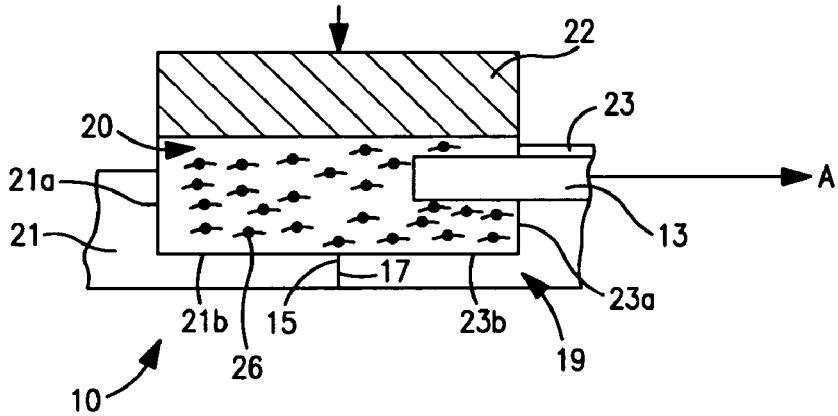

Regardless, after filling, the die cavity 20 is closed from as shown in FIG. 1B by an upper punch 22. It should be understood that additional punches (e.g., a lower punch) may also be utilized. The present inventors have discovered that the direction in which the compressive forces are exerted may provide improved properties to the resulting capacitor. For example, as illustrated by the directional arrows in FIG. 1B, the force exerted by the punch 22 is in a direction that is substantially "perpendicular" to a longitudinal axis "A" of the wire 13. That is, the force is typically exerted at an angle of from about 600 to about 1200, and preferably about 900 relative to the axis "A." In this manner, the wire 13 is embedded into the powder 26 so that it may slip into the space between adjacent flakes.

Figure 2:
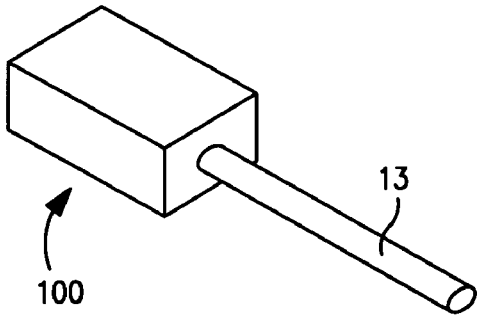
FIG. 2 is a cross-sectional view of one embodiment of a pressed tantalum pellet formed according to the present invention.

The resulting pressed pellet 100 is shown in FIG. 2. Without intending to be limited by theory, the present inventors believe that the "perpendicular" pressing technique causes the pellet 100 to contain flakes generally oriented in the direction of the longitudinal axis "A" of the wire 13. This forces the flakes into close contact with the wire 13 and creates a strong wire-to-powder bond. In addition, the "perpendicular" pressing technique also reduces the likelihood that the wire 13 will be bent, thereby decreasing the likelihood of cracks or weak areas. On the other hand, "parallel" pressing techniques (i.e., force exerted by the punch 22 is in a direction that is substantially parallel to the longitudinal axis "A" of the wire 13) would generally orient the flakes in a direction perpendicular to the wire 13. It is believed that such orientation would result in a barrier between the flakes and wire that would tend to bend the wire instead of allowing it to penetrate the powder. Thus, using the "perpendicular" pressing technique of the present invention, a strong pellet may be formed from low density flake powder.

Once formed, any binder/lubricant present may be removed by heating the pellet under vacuum at a certain temperature (e.g., from about 150° C. to about 500° C.) for several minutes. Alternatively, the binder/lubricant may also be removed by contacting the pellet with an aqueous solution, such as described in U.S. Pat. No. 6,197,252 to Bishop, et al., which is incorporated herein in its entirety by reference thereto for all purposes. Thereafter, the resulting pellet is sintered to form a porous, integral mass. For example, in one embodiment, a pellet formed from tantalum flake powder may be sintered at a temperature of from about 1200° C. to about 2000° C., and in some embodiments, from about 1500° C. to about 1800° C. under vacuum. Upon sintering, the pellet shrinks due to the growth of metallurgical bonds between the flakes. Because shrinkage generally increases the density of the pellet, the present inventors have discovered that lower press densities ("green") may be employed to still achieve the desired target density. For example, the target density of the pellet after sintering is typically from about 4 to about 7 grams per cubic centimeter, and in some embodiments, from about 4.5 to about 6 grams per cubic centimeter. As a result of the shrinking phenomenon, however, the pellet need not be pressed to such high densities, but may instead be pressed to densities of less than about 5 grams per cubic centimeter, and in some embodiments, less than about 4 grams per cubic centimeter. Among other things, the ability to employ lower green densities may provide significant cost savings and increase processing efficiency.

In addition, the pressed density may not be uniform across the pellet due to the fact that compression occurs in a direction perpendicular to the longitudinal axis of the wire. Namely, the pressed density is determined by dividing the amount of material by the volume of the pressed pellet. The volume of the pellet is directly proportional to the compressed length in the direction perpendicular to the longitudinal axis of the wire. Thus, the density is inversely proportional to the compressed length. In the present invention, the thickness of the wire is generally subtracted from the compressed length for use in this density calculation. Thus, the compressed length is actually lower at those locations adjacent to the wire than the remaining locations of the pellet. The pressed density is likewise greater at those locations adjacent to the wire. For example, the density of the pellet at those locations adjacent to the wire is typically at least about 10% greater, and in some cases, at least about 20% greater than the pressed density of the pellet at the remaining locations of the pellet.

After forming the anode, a dielectric film may then be formed. For example, in one embodiment, the anode is anodized such that a dielectric film is formed over and within the porous anode. Anodization is an electrical chemical process by which the anode metal is oxidized to form a material having a relatively high dielectric constant. For example, a tantalum anode may be anodized to form tantalum pentoxide ($Ta_2O_5$), which has a dielectric constant "k" of about 27. Specifically, in one embodiment, the tantalum pellet is dipped into a weak acid solution (e.g., phosphoric acid) at an elevated temperature (e.g., about 85° C.) that is supplied with a controlled amount of voltage and current to form a tantalum pentoxide coating having a certain thickness. The power supply is initially kept at a constant current until the required formation voltage is reached. Thereafter, the power supply is kept at a constant voltage to ensure that the desired dielectric thickness is formed over the surface of the tantalum pellet. The anodization voltage typically ranges from about 10 to about 200 volts, and in some embodiments, from about 20 to about 100 volts. In addition to being formed on the surface of the tantalum pellet, a portion of the dielectric oxide film will form on the surfaces of the pores of the metal. It should be understood that the dielectric film may be formed from other types of materials and using different techniques.

Once the dielectric film is formed, a protective coating may optionally be applied, such as a relatively insulative resinous materials (natural or synthetic). Such materials may have a resistivity of greater than about 0.05 ohm-cm, in some embodiments greater than about 5, in some embodiments greater than about 1,000 ohm-cm, in some embodiments greater than about $1\times10^5$ ohm-cm, and in some embodiments, greater than about $1\times10^{10}$ ohm-cm. Some resinous materials that may be utilized in the present invention include, but are not limited to, polyurethane, polystyrene, esters of unsaturated or saturated fatty acids (e.g., glycerides), and so forth. For instance, suitable esters of fatty acids include, but are not limited to, esters of lauric acid, myristic acid, palmitic acid, stearic acid, eleostearic acid, oleic acid, linoleic acid, linolenic acid, aleuritic acid, shellolic acid, and so forth. These esters of fatty acids have been found particularly useful when used in relatively complex combinations to form a "drying oil", which allows the resulting film to rapidly polymerize into a stable layer. Such drying oils may include mono-, di-, and/or tri-glycerides, which have a glycerol backbone with one, two, and three, respectively, fatty acyl residues that are esterified. For instance, some suitable drying oils that may be used include, but are not limited to, olive oil, linseed oil, castor oil, tung oil, soybean oil, and shellac. These and other protective coating materials are described in more detail U.S. Pat. No. 6,674,635 to Fife, et al., which is incorporated herein in its entirety by reference thereto for all purposes.

The anodized part is thereafter subjected to a step for forming cathodes according to conventional techniques. In some embodiments, for example, the cathode is formed by pyrolytic decomposition of manganous nitrate ($Mn(NO_3)_2$) to form a manganese dioxide ($MnO_2$) cathode. Such techniques are described, for instance, in U.S. Pat. No. 4,945,452 to Sturmer, et al., which is incorporated herein in its entirety by reference thereto for all purposes. Alternatively, a conductive polymer coating may be used to form the cathode of the capacitor. The conductive polymer coating may contain one or more conductive polymers, such as polypyrroles; polythiophenes, such as poly(3,4-ethylenedioxy thiophene) (PEDT); polyanilines; polyacetylenes; poly-p-phenylenes; and derivatives thereof. Moreover, if desired, the conductive polymer coating may also be formed from multiple conductive polymer layers. For example, in one embodiment, the conductive polymer coating may contain one layer formed from PEDT and another layer formed from a polypyrrole. Various methods may be utilized to apply the conductive polymer coating onto the anode part. For instance, conventional techniques such as sputtering, screen-printing, dipping, electrophoretic coating, electron beam deposition, spraying, and vacuum deposition, may be used to form a conductive polymer coating. In one embodiment, for example, the monomer(s) used to form the conductive polymer (e.g., PEDT), can initially be mixed with a polymerization catalyst to form a dispersion. For example, one suitable polymerization catalyst is BAYTRON C, which is iron III toluene-sulphonate and n-butanol and sold by Bayer Corporation. BAYTRON C is a commercially available catalyst for BAYTRON M, which is 3,4-ethylene dioxythiophene, a PEDT monomer also sold by Bayer Corporation.

Once a catalyst dispersion is formed, the anode part may then be dipped into the dispersion so that the polymer forms on the surface of the anode part. Alternatively, the catalyst and monomer(s) may also be applied separately to the anode part. In one embodiment, for example, the catalyst may be dissolved in a solvent (e.g., butanol) and then applied to the anode part as a dipping solution. The anode part may then be dried to remove the solvent therefrom. Thereafter, the anode part may be dipped into a solution containing the appropriate monomer. Once the monomer contacts the surface of the anode part containing the catalyst, it chemically polymerizes thereon. In addition, the catalyst (e.g., BAYTRON C) may also be mixed with the material(s) used to form the optional protective coating (e.g., resinous materials). In such instances, the anode part may then be dipped into a solution containing the conductive monomer (BAYTRON M). As a result, the conductive monomer can contact the catalyst within and/or on the surface of the protective coating and react therewith to form the conductive polymer coating. Although various methods have been described above, it should be understood that any other method for applying the conductive coating(s) to the anode part may also be utilized in the present invention. For example, other methods for applying such conductive polymer coating(s) may be described in U.S. Pat. Nos. 5,457,862 to Sakata, et al., 5,473,503 to Sakata, et al., 5,729,428 to Sakata, et al., and 5,812,367 to Kudoh, et al., which are incorporated herein in their entirety by reference thereto for all purposes.

In most embodiments, once applied, the conductive polymer is healed. Healing may occur after each application of a conductive polymer layer or may occur after the application of the entire conductive polymer coating. In some embodiments, for example, the conductive polymer may be healed by dipping the pellet into an electrolyte solution, such as a solution of phosphoric acid and/or sulfuric acid, and thereafter applying a constant voltage to the solution until the current is reduced to a preselected level. If desired, such healing may be accomplished in multiple steps. For instance, in one embodiment, a pellet having a conductive polymer coating is first dipped in phosphoric acid and applied with about 20 volts and then dipped in sulfuric acid and applied with about 2 volts. In this embodiment, the use of the second low voltage sulfuric acid solution or toluene sulphonic acid can help increase capacitance and reduce the dissipation factor (DF) of the resulting capacitor. After application of some or all of the layers described above, the pellet may then be washed if desired to remove various byproducts, excess catalysts, and so forth. Further, in some instances, drying may be utilized after some or all of the dipping operations described above. For example, drying may be desired after applying the catalyst and/or after washing the pellet in order to open the pores of the pellet so that it can receive a liquid during subsequent dipping steps. Once the conductive polymer coating is applied, the anode part may then be dipped into a graphite dispersion and dried. Further, the anode part may also be dipped into silver paste and dried. The silver coating may act as a solderable conductor for the capacitor and the graphite coating may prevent the silver coating from directly contacting the conductive polymer coating(s).

The resultant capacitor may have a cathode lead applied thereto as by soldering or alternatively a conductor may be engaged against the silver surface and maintained in position by heat shrinking an insulative plastic sleeve over the body of the capacitor. Numerous alternate techniques for applying cathode leads are well known in the industry. An anode lead of matching conductive material may also be attached by first cutting the wire to within a short distance of the body of the capacitor and then welding the anode lead to the remaining tantalum wire by capacitive discharge or other similar technique. The finished capacitor may be encapsulated by dipping or other method known in the industry.

Thus, as a result of the present invention, a capacitor may be formed that exhibits excellent electrical properties. For example, the technique of the present invention is believed to form good electrical and mechanical contact between the wire and the tantalum flake powder. This mechanically stable interface leads to a highly continuous and dense wire-to-anode connection with high conductivity, thereby providing low equivalent series resistance (ESR). The equivalent series resistance of a capacitor generally refers to the extent that the capacitor acts like a resistor when charging and discharging in an electronic circuit and is usually expressed as a resistance in series with the capacitor. For example, a capacitor of the present invention may have an ESR of less than about 300 milliohms, in some embodiments less than about 200 milliohms, and in some embodiments, less than about 100 milliohms, measured with a 2-volt bias and 1-volt signal at a frequency of 2 MHz.

It is also believed that the dissipation factor (DF) of the capacitor may also be maintained at relatively low levels. The dissipation factor (DF) generally refers to losses that occur in the capacitor and is usually expressed as a percentage of the ideal capacitor performance. For example, the dissipation factor of a capacitor of the present invention is typically less than about 10%, and in some embodiments, less than about 5%. Such low ESR and DF values may be achieved even in the high frequency range (e.g., 40 MHz). Further, the specific charge may be greater than about 10,000 μF*V/g, in some embodiments, greater than about 20,000 μF*V/g, and in some embodiments, greater than about 40,000 μF*V/g.

The present invention may be better understood by reference to the following examples.

TEST PROCEDURES

Screen Size Distribution

The screen size distribution of the powder was determined using a Rotap model RX-29 made by W.S. Tyler Company, a collection pan and lid made by Fisher Scientific Company (ASTM E-11), and a Mettler Balance model PB3002-S.

Sieves (US Standard Test Sieve, 8-inch diameter, numbers 40, 60, 100, 200, and 325) were stacked with the smallest number on top to the largest number on the bottom with a collection pan underneath. The sieves were the positioned on the Rotap machine. 20 grams of the sample were then placed onto the top sieve and covered. The tapping arm was lowered in place and the machine was run for 3 minutes. When the machine stopped, the sieves were removed and the material collected in each sieve and collection pan was weighed. The amount of material was recorded and divided by the total amount collected to determine the percent of that particular particle size.

Specific Surface Area

The term "specific surface area was determined by the physical gas adsorption (B.E.T.) method of Bruanauer, Emmet, and Teller, Journal of American Chemical Society, Vol. 60, 1938, p. 309, with nitrogen as the adsorption gas. Specifically, specific surface area was measured with a MONOSORB® Specific Surface Area Analyzer available from QUANTACHROME Corporation, Syosset, N.Y., U.S.A. This apparatus measures the quantity of adsorbate nitrogen gas adsorbed on a solid surface by sensing the change in thermal conductivity of a flowing mixture of adsorbate and inert carrier gas (e.g., helium). The methods and procedures for making these measurements are described in the instruction manual for the MONOSORB® apparatus.

Bulk Density

The term "bulk density" (or Scott density) was determined using a flowmeter funnel and density cup. The measurement was made by pouring a flake sample through the funnel into the cup until the sample completely filled and overflowed the periphery of the cup. Then, the sample was leveled-off by a spatula, without jarring, so that it was flush with the top of the cup. The leveled sample was transferred to a balance and weighed to the nearest 0.1 gram. Such an apparatus is commercially available from Alcan Aluminum Corp. of Elizabeth, N.J.

Capacitance and Dissipation Factor

The capacitance and dissipation factor were measured using an Agilent 4284A Precision LCR meter with Agilent 16089B Kelvin Leads with 2 volts bias and 1 volt signal. Operating frequencies of 120 Hz; 200 Hz; 500 Hz; 1 kHz; 2 kHz; 5 kHz; 10 kHz; 20 kHz; 50 kHz; 100 kHz; 200 kHz; 500 kHz; 1 MHz; 2 MHz; 5 MHz; 10 MHz; 20 MHz; and 40 MHz were tested.

Equivalent Series Resistance (ESR) and Impedance

Equivalence series resistance and impedance were measured using an Agilent 4284A Precision LCR meter with Agilent 16089B Kelvin Leads with 2 volts bias and 1 volt signal. Operating frequencies of 120 Hz; 200 Hz; 500 Hz; 1 kHz; 2 kHz; 5 kHz; 10 kHz; 20 kHz; 50 kHz; 100 kHz; 200 kHz; 500 kHz; 1 MHz; 2 MHz; 5 MHz; 10 MHz; 20 MHz; and 40 MHz were tested.

EXAMPLE 1

The ability to form a tantalum flake powder in accordance with the present invention was demonstrated. Initially, tantalum powder was obtained from H.C. Starck Corp. (Newton, Mass.) under the designation "NH175" and formed into tantalum flake using an HDDM Attritor mill made by Union Process. Specifically, an empty stainless steel milling pot was first weighed. 4405.5 grams of 440 stainless steel milling media and 50 grams of the tantalum powder were poured into the milling pot in conjunction with 300 milliliters of ethanol. The milling speed was 500 revolutions per minutes (rpms). The temperature of the cooling water was reduced to maintain a target temperature not to exceed 30° C. Once the mill stopped, the milling pot was then removed from the cooling jacket. The mixture of tantalum flake, stainless steel milling media, and ethanol was emptied from the milling jar through a course screen to separate the milling media. Next, the tantalum flake and ethanol were washed with deionized water to remove the residual ethanol. The rinsed flake was acid leached in a mixture of 100 milliliters of deionized water with 100 milliliters of concentrated $HNO_3$ and 300 milliliters of concentrated HCl. The acid treatment was conducted with stirring at 50° C. for 8 hours. The leached flake was washed with de-ionized water to remove residual $HNO_3$ and HCl, then acid leached in 200 milliliters deionized water with 200 milliliters concentrated HCl and 2.6 milliliters of 48% HF at room temperature for 30 minutes. The leached flake was rinsed with deionized water until the rinse water conductivity was less than 1 μS ("μS"). Thereafter, the powder was dried at 100° C. in an oven (in a stainless steel tray) for 2 hours.

The resulting powder had a Scott Density of 0.312 grams per cubic centimeter and a B.E.T. surface area of 2.714 square meters per gram. In addition, the powder also had the screen size distribution as set forth below in Table 1:

TABLE 1

Properties of Milled and Acid-Leached Powder

| Mesh No. | % of Particles | Microns |
|---|---|---|
| >40 | 0.00 | >420 |
| 40-60 | 25.91 | 420-250 |
| 60-100 | 56.82 | 250-149 |
| 100-200 | 12.65 | 149-74 |
| 200-325 | 3.82 | 74-44 |
| <325 | 0.80 | <44 |

Figure 3:
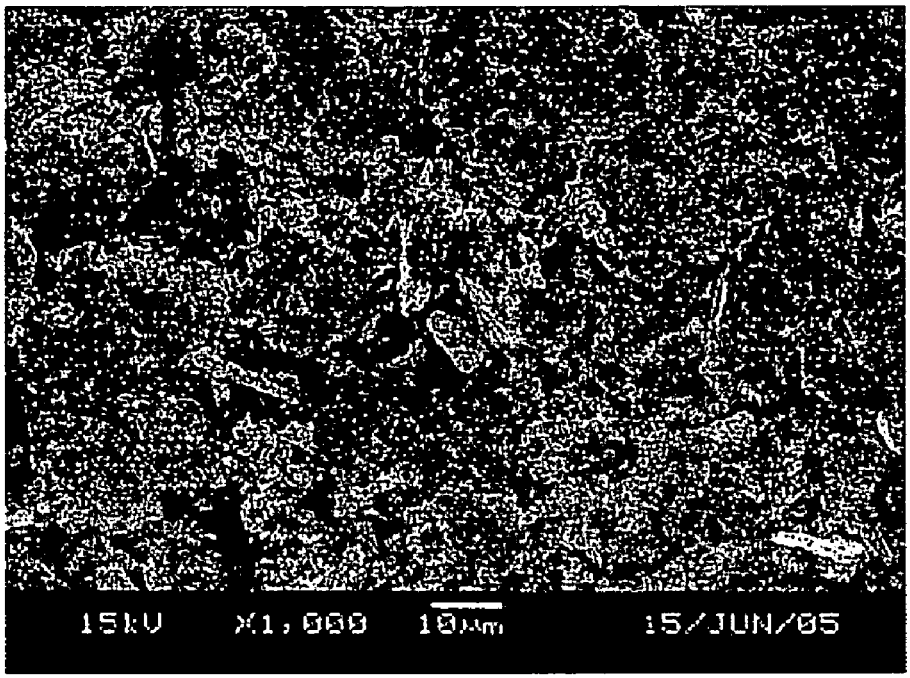
FIG. 3 is a scanning electron microphotograph ("SEM") of the milled tantalum powder of Example 1, taken at a magnification of 1,000× (15 kV)
Figure 4:
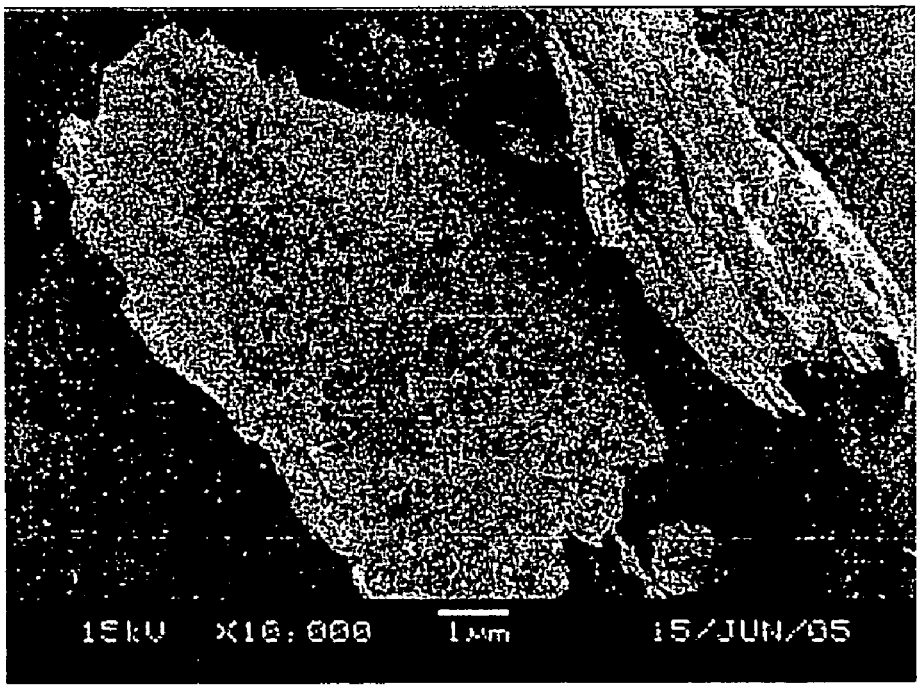
FIG. 4 is an SEM microphotograph of the milled tantalum powder of Example 1, taken at a magnification of 10,000× (15 kV)

SEM photographs of the resulting powder are also shown in FIGS. 3 and 4.

EXAMPLE 2

The tantalum flake powder of Example 1 was agglomerated by sintering the powder in two separate heat treatment steps. First, the flake powder was placed into clean tantalum trays and covered with tantalum lids. The tantalum trays were placed into a vacuum furnace and sintered at 1313° C. for 30 minutes. The trays were removed from the furnace and the flake was taken out of the trays. Using a strip of tantalum sheet metal as a crusher, the flake was passed through a 40-mesh sieve. Any flake that did not pass through the sieve was discarded. Thereafter, the powder was weighed and 21 grams of a $H_3PO_4$ solution was added. The $H_3PO_4$ solution was prepared by diluting 0.43 grams of $H_3PO_4$ in 1000 milliliters of deionized water. The flake was then dried in an oven at 100° C. for 2 hours and placed into clean tantalum trays. The trays were inserted into a vacuum furnace and sintered at 1390° C. for 30 minutes. The trays were removed from the furnace and the flake was taken out of the trays. The flake was again passed through a 40-mesh sieve using a strip of tantalum sheet metal as a crusher, with any flake not passing through the sieve being discarded. The yield of the powder was 36.674 grams.

EXAMPLE 3

Excess oxygen was removed from the powder obtained in Example 2 to reduce its brittleness. Specifically, 1.1 grams of magnesium was added to the 36.674 grams of tantalum flake. The mixture was then placed into tantalum trays, which were inserted into a hot wall furnace lined with a nickel-chromium alloy (Inconel®). The furnace was heated to 900° C. for 1 hour under the flow of argon. After the furnace was cooled to below 50° C., the argon flow ended and air was introduced at a rate of 0.5 cubic feet per hour. The flow rate was increased to approximately 1 cubic foot per hour after about 1 hour. Once the flake had been passivated, the trays were removed from the furnace. Thereafter, approximately 1500 grams of deionized ice and 1500 milliliters of nitric acid were added to a glass beaker with a stir bar. This beaker was placed on a stir plate that is in a glass containment tray. Once the ice had melted, the deoxidized flake was slowly added and stirred for 30 minutes. Stirring was then stopped and the flake was allowed to settle at the bottom of the beaker. The nitric acid was decanted into a glass beaker for neutralization. The flake was rinsed with deionized water and decanted into a glass beaker for neutralization. The rinsing steps were repeated until the pH of the solution was neutral. Then, the flake solution was poured into a Buchner funnel that contained a P2 filter paper. Deionized water was filtered through the flake until the conductivity of the water was less than 1 μS. Once clean, the flake and filter paper were placed into a stainless steel pan with a lid. The pan was dried in an oven at 100° C.

The resulting powder had a Scott Density of 0.513 grams per cubic centimeter and a B.E.T. surface area of 2.4345 square meters per gram. In addition, the powder also had the screen size distribution as set forth below in Table 2:

TABLE 2

Properties of Final Powder

| Mesh No. | % of Particles | Microns |
|---|---|---|
| >40 | 12.37 | 420-250 |
| 40-60 | 13.73 | 250-149 |
| 60-100 | 12.32 | 149-74 |
| 100-200 | 24.18 | 74-44 |
| 200-325 | 37.30 | <44 |
| <325 | 12.37 | 420-250 |

EXAMPLE 4

A tantalum flake powder was formed as described in Example 1, except that the acid leaching conditions were varied. More specifically, the flake solution was poured into a 4000-milliliter beaker and the flask was rinsed into the beaker. The contents of the beaker were then stirred for a couple of minutes and the flake was allowed to settle for approximately 1 hour. The water was decanted and discarded. The stirring/decanting steps were repeated to remove any residual ethanol from the powder. Thereafter, the beaker was filled with approximately 500 milliliters of deionized water. A Teflon-coated stir bar was placed in the beaker and on the stir plate. After initiating agitation with the stir bar, approximately 500 milliliters of $HNO_3$ and 1500 milliliters of HCl were added to the solution. A glass cover was placed over the beaker and allowed to stir overnight. Thereafter, the stir plate was turned off and the flake was allowed to settle for approximately 1 hour. The solution was then decanted. The resulting flake was rinsed with deionized water, allowed to settle, and then decanted. Once the flake was rinsed, approximately 1500 milliliters of deionized water and approximately 1500 milliliters of HCl were added. When the HCl solution remained clear, the mixture was transferred to a plastic beaker with a Teflon-coated stir bar and placed on a stir plate sitting in a plastic containment tray. 4 milliliters of hydrofluoric acid (HF) was added and allowed to stir for 30 minutes. The flake was then allowed to settle to the bottom of the beaker and solution was decanted into a plastic beaker. The flake was rinsed several times until pH paper indicated neutral. The powder was then filtered using a Buchner funnel and P2 filter paper. The powder was rinsed with deionized water until the conductivity of the water was less than 1 μS. Thereafter, the powder was dried at 100° C. in an oven (in a stainless steel tray) for 2 hours.

The resulting powder had a Scott Density of 0.304 grams per cubic centimeter and a B.E.T. surface area of 2.778 square meters per gram. In addition, the powder also had the screen size distribution as set forth below in Table 3:

TABLE 3

Properties of Milled and Acid-Leached Powder

| Mesh No. | % of Particles | Microns |
|---|---|---|
| >40 | 0.00 | >420 |
| 40-60 | 55.65 | 420-250 |
| 60-100 | 32.48 | 250-149 |
| 100-200 | 8.16 | 149-74 |
| 200-325 | 2.76 | 74-44 |
| <325 | 0.95 | <44 |

Figure 5:
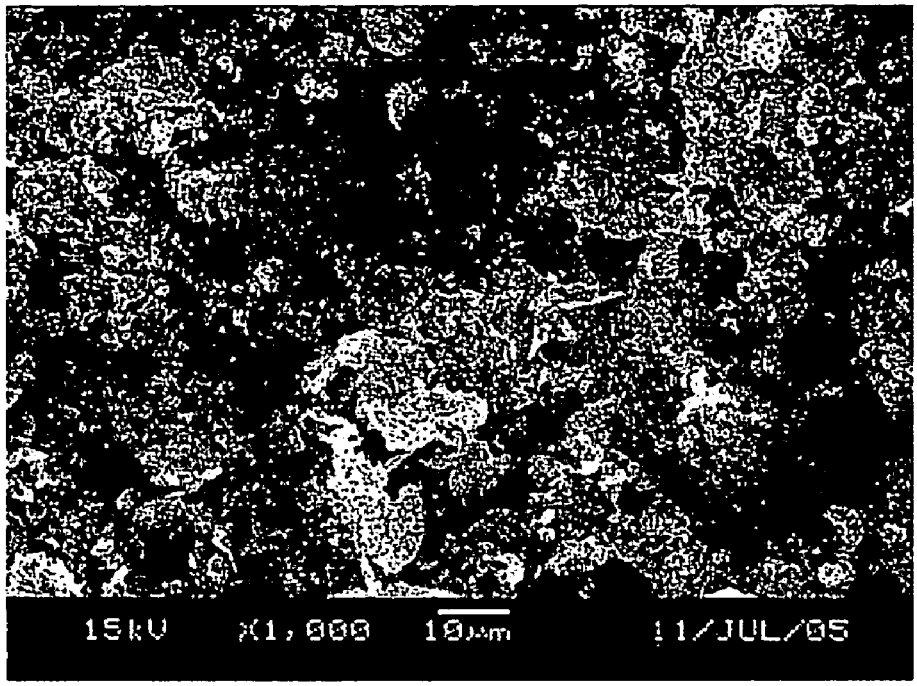
FIG. 5 is an SEM microphotograph of the milled tantalum powder of Example 4, taken at a magnification of 1,000× (15 kV)
Figure 6:
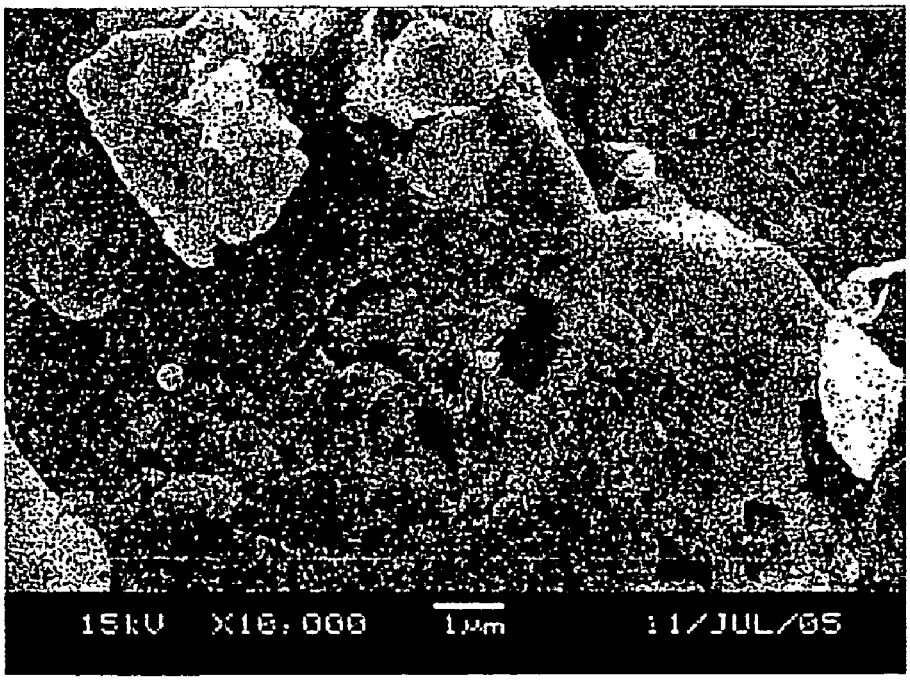
FIG. 6 is an SEM microphotograph of the milled tantalum powder of Example 4, taken at a magnification of 10,000× (15 kV)

SEM photographs of the resulting powder are also shown in FIGS. 5 and 6.

The powder was then agglomerated as described in Example 2, except that the first sintering treatment was at 1335° C. for 30 minutes. In addition, 300 grams of diluted $H_3PO_4$ was added to the powder, dried at 100° C. for 4 hours, and then sintered for 30 minutes at 1410° C. The yield of the flake powder of 532.62 grams. The powder was also deoxidized as described in Example 3, except that 16 grams of magnesium was employed. The resulting powder had a Scott Density of 0.513 grams per cubic centimeter and a B.E.T. surface area of 2.4345 square meters per gram. In addition, the powder also had the screen size distribution as set forth below in Table 4:

TABLE 4

Properties of Final Powder

| Mesh No. | % of Particles | Microns |
|---|---|---|
| >40 | 0.00 | >420 |
| 40-60 | 8.41 | 420-250 |
| 60-100 | 17.89 | 250-149 |
| 100-200 | 16.21 | 149-74 |
| 200-325 | 11.77 | 74-44 |
| <325 | 45.72 | <44 |

EXAMPLE 5

A tantalum flake powder was formed as described in Example 1, except that 400 milliliters of ethanol was used during milling and the acid leaching conditions were varied. More specifically, the flake solution was poured into a 4000-milliliter beaker and the flask was rinsed into the beaker. The contents of the beaker were then stirred for a couple of minutes and the flake was allowed to settle for approximately 1 hour. The water was decanted and discarded. The stirring/decanting steps were repeated to remove any residual ethanol from the powder. Thereafter, the beaker was filled with approximately 500 milliliters of deionized water. Once the flake was rinsed, approximately 1500 milliliters of deionized water and approximately 1500 milliliters of HCl were added.

When the HCl solution remained clear, the mixture was transferred to a plastic beaker with a Teflon-coated stir bar and placed on a stir plate sitting in a plastic containment tray. 8 milliliters of hydrofluoric acid (HF) was added and allowed to stir for 30 minutes. The flake was then allowed to settle to the bottom of the beaker and solution was decanted into a plastic beaker. The flake was rinsed several times until pH paper indicated neutral. The powder was then filtered using a Buchner funnel and P2 filter paper. The powder was rinsed with deionized water until the conductivity of the water was less than 1 μS. Thereafter, the powder was dried at 100° C. in an oven (in a stainless steel tray) for 2 hours.

The resulting powder had a Scott Density of 0.349 grams per cubic centimeter and a B.E.T. surface area of 1.742 square meters per gram. In addition, the powder also had the screen size distribution as set forth below in Table 5:

TABLE 5

Properties of Milled and Acid-Leached Powder

| Mesh No. | % of Particles | Microns |
|---|---|---|
| >40 | 0.00 | >420 |
| 40-60 | 1.38 | 420-250 |
| 60-100 | 34.86 | 250-149 |
| 100-200 | 41.25 | 149-74 |
| 200-325 | 18.78 | 74-44 |
| <325 | 3.73 | <44 |

Figure 7:
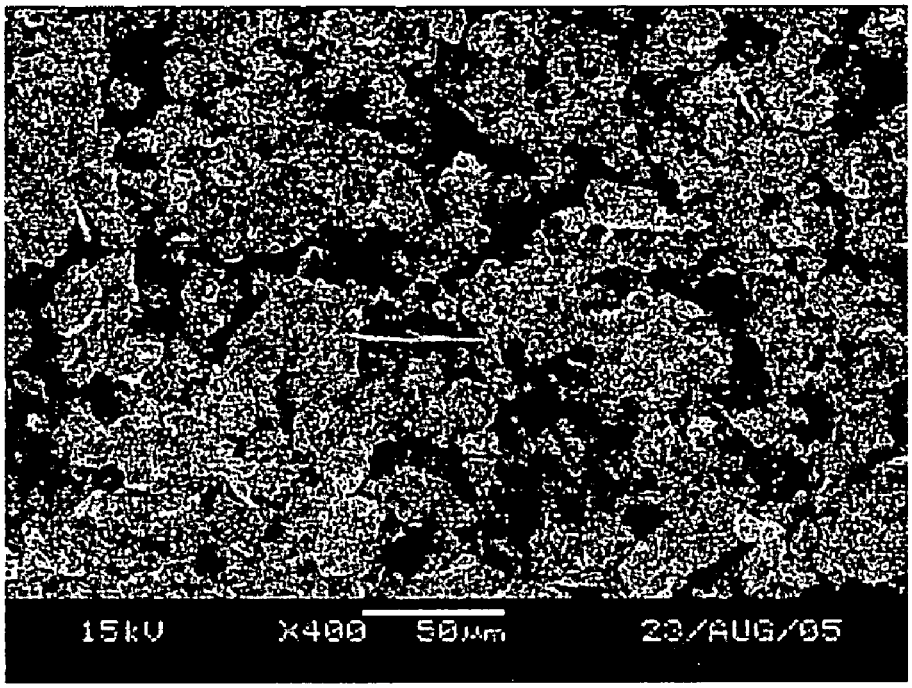
FIG. 7 is an SEM microphotograph of the milled tantalum powder of Example 5, taken at a magnification of 400× (15 kV)
Figure 8:
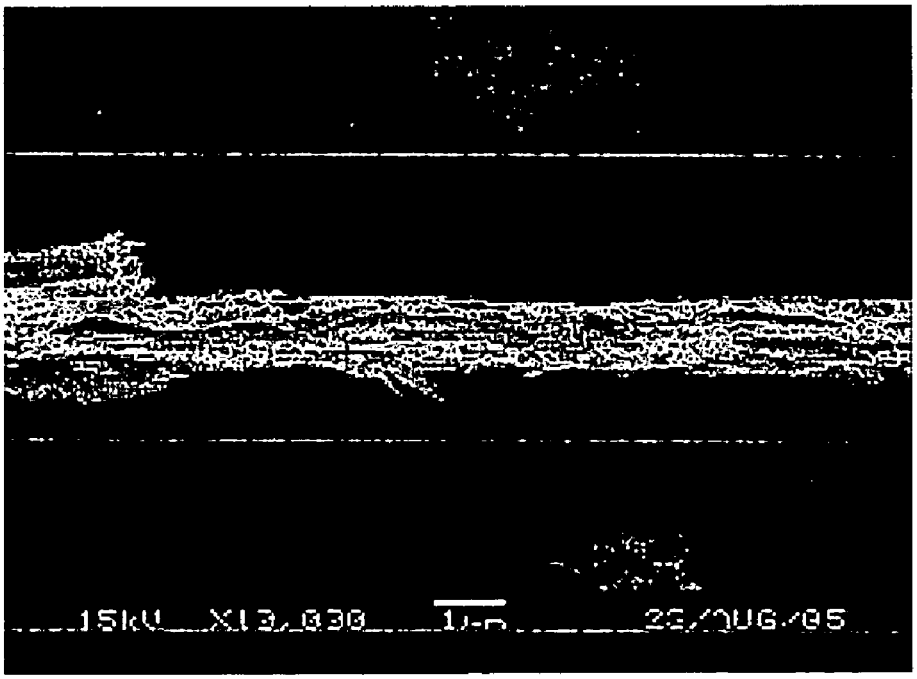
FIG. 8 is an SEM microphotograph of the milled tantalum powder of Example 5, taken at a magnification of 10,000× (15 kV)

SEM photographs of the resulting powder are also shown in FIGS. 7 and 8.

The powder was then agglomerated as described in Example 2, except that the first sintering treatment was at 1335° C. for 30 minutes. In addition, 127 grams of diluted $H_3PO_4$ was added to the powder, dried at 100° C. for 2 hours, and then sintered for 30 minutes at 1410° C. The yield of the flake powder of 224.65 grams. The powder was also deoxidized as described in Example 3, except that 6.74 grams of magnesium was employed. The resulting powder had a Scott Density of 0.483 grams per cubic centimeter and a B.E.T. surface area of 1.464 square meters per gram. In addition, the powder also had the screen size distribution as set forth below in Table 6:

TABLE 6

Properties of Final Powder

| Mesh No. | % of Particles | Microns |
|---|---|---|
| >40 | 0.15 | >420 |
| 40-60 | 13.18 | 420-250 |
| 60-100 | 10.20 | 250-149 |
| 100-200 | 13.73 | 149-74 |
| 200-325 | 24.38 | 74-44 |
| <325 | 38.36 | <44 |

EXAMPLE 6

Figure 9:
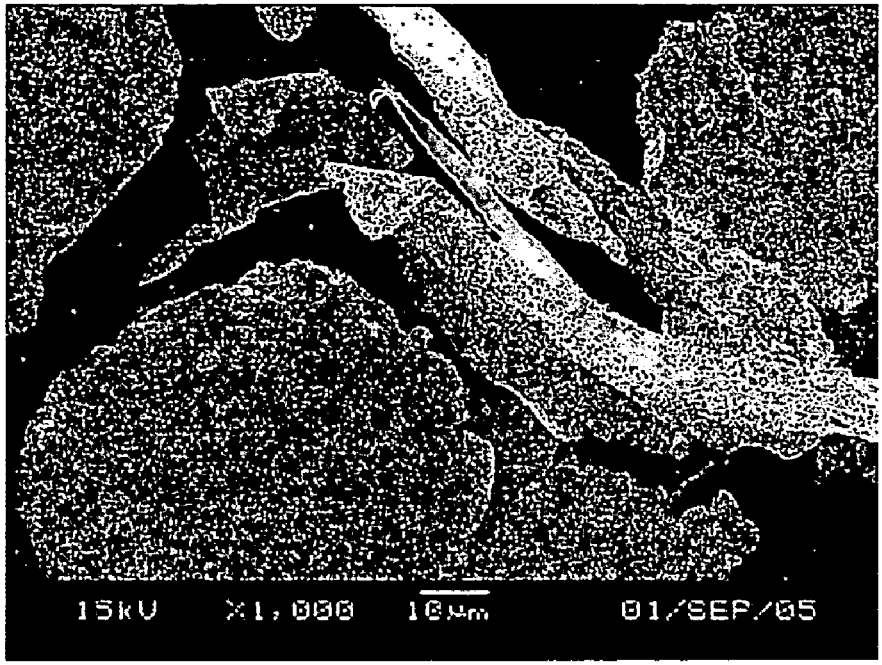
FIG. 9 is an SEM microphotograph of the milled tantalum powder of Example 6, taken at a magnification of 1,000× (15 kV)
Figure 10:
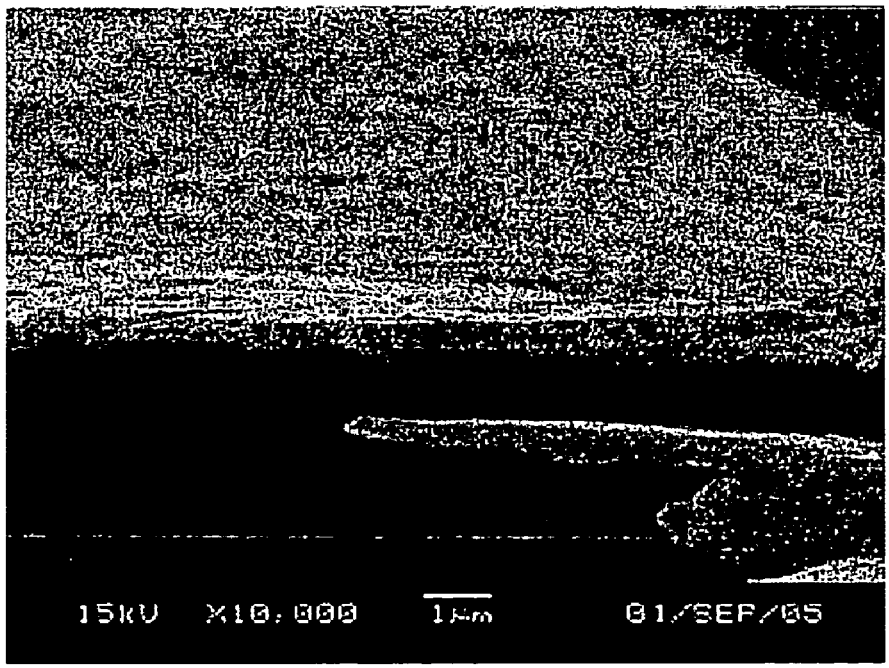
FIG. 10 is an SEM microphotograph of the milled tantalum powder of Example 6, taken at a magnification of 10,000× (15 kV)

A tantalum flake powder was formed as described in Example 1, except that the milling time was only 1.5 hours and only 1.2 milliliters of hydrofluoric acid (HF) was used during acid leaching. After the acid leach process, the flake solution was wet sieved and the material between 60 mesh and 325 mesh was collected for processing. The remaining flake was filtered out of solution and scrapped. The resulting powder had a Scott Density of 0.210 grams per cubic centimeter and a B.E.T. surface area of 0.776 square meters per gram. SEM photographs of the powder are shown in FIGS. 9-10. The powder was then agglomerated as described in Example 2, except that only one sintering step was employed. More specifically, 3.0 grams of diluted $H_3PO_4$ was added to the powder, dried at 100° C. for 2 hours, and then sintered for 30 minutes at 1285° C. The yield of the flake powder of 6.95 grams. The powder was also deoxidized as described in Example 3, except that 0.21 grams of magnesium was employed. The resulting powder had a Scott Density of 0.251 grams per cubic centimeter and a B.E.T. surface area of 1.4255 square meters per gram.

EXAMPLE 7

The ability to form a capacitor anode using the powder of Example 3 was demonstrated. More specifically, the powder was manually loaded into the anode cavity of a side press (obtained from Barbuto Design Co. of Dalton, Mass. under the trade designation Automatic Embedded Wire Press Serial No. 101589). The cavity depth was set at 10.5 millimeters, and the length and width of the cavity were 3.55 and 2.85 millimeters, respectively. The wire had a diameter of 0.24 millimeters and a length of 9.60 millimeters. The amount of flake used per anode was approximately 0.0428 grams and pressed to the dimensions of 3.58×2.93×0.75 millimeters with an average press density of 4.5 grams per cubic centimeter. The region of the anode just above and below the wire was pressed to 5.0 grams per cubic centimeters, which was caused by the embedded wire. The resulting anodes were sintered at 1460° C. for 30 minutes and then anodized at 64 volts. The CV/g was 31,182.

EXAMPLE 8

The ability to form a capacitor anode using the powder of Example 4 was demonstrated. More specifically, the powder was manually loaded into the anode cavity of a side press (obtained from Barbuto Design Co. of Dalton, Mass. under the trade designation Automatic Embedded Wire Press Serial No. 101589). The cavity depth was set at 10.5 millimeters, and the length and width of the cavity were 3.55 and 2.85 millimeters, respectively. The wire had a diameter of 0.24 millimeters and a length of 9.60 millimeters. The amount of flake used per anode was approximately 0.0428 grams and pressed to the dimensions of 3.58×2.93×0.75 millimeters with an average press density of 5.0 grams per cubic centimeter. The region of the anode just above and below the wire was pressed to 5.5 grams per cubic centimeters, which was caused by the embedded wire. The resulting anodes were sintered for 30 minutes at varying temperatures (i.e., 1410° C., 1460° C., 1510° C., and 1560° C.) for 30 minutes and then anodized at varying voltages (i.e., 64, 80, 100, 120, 140, 160, and 180 volts). The resulting CV/g values are set forth below in Table 7.

TABLE 7

Specific Charge Values

| Volts | 1410° C. | 1460° C. | 1510° C. | 1560° C. |
|---|---|---|---|---|
| 64 | 29459 | 26706 | 23472 | 17838 |
| 80 | 26713 | 24632 | 21340 | 17034 |
| 100 | 22854 | 21488 | 19195 | 15502 |
| 120 | 19107 | 18467 | 16456 | 13727 |
| 140 | — | — | 13724 | 12421 |
| 160 | — | — | 11107 | 10653 |
| 180 | — | — | — | 8614 |

EXAMPLE 9

The ability to form a capacitor anode using the powder of Example 5 was demonstrated. More specifically, the powder was manually loaded into the anode cavity of a side press (obtained from Barbuto Design Co. of Dalton, Mass. under the trade designation Automatic Embedded Wire Press Serial No. 101589). The cavity depth was set at 10.5 millimeters, and the length and width of the cavity were 3.55 and 2.85 millimeters, respectively. The wire had a diameter of 0.24 millimeters and a length of 9.60 millimeters. The amount of flake used per anode was approximately 0.0428 grams and pressed to the dimensions of 3.58×2.93×0.75 millimeters with an average press density of 4.5 grams per cubic centimeter. The region of the anode just above and below the wire was pressed to 5.0 grams per cubic centimeters, which was caused by the embedded wire. The resulting anodes were sintered for 30 minutes at varying temperatures (i.e., 1410° C., 1460° C., 1510° C., and 1560° C.) for 30 minutes and then anodized at varying voltages (i.e., 64, 80, 100, 120, 140, 160, and 180 volts). The resulting CV/g values are set forth below in Table 8.

TABLE 8

| | Specific Charge Values | | | |
|---|---|---|---|---|
| Volts | 1410° C. | 1460° C. | 1510° C. | 1560° C. |
| 64 | 28867 | 26871 | 24044 | 19999 |
| 80 | 26700 | 25023 | 22568 | 19105 |
| 100 | 23528 | 22360 | 20613 | 17592 |
| 120 | 20228 | 19535 | 18252 | 15958 |
| 140 | 17423 | 17327 | 16315 | 14776 |
| 160 | 14783 | 15098 | 14603 | 13544 |
| 180 | — | — | — | 11999 |

EXAMPLE 10

The ability to form a capacitor anode using the powder of Example 6 was demonstrated. More specifically, the powder was manually loaded into the anode cavity of a side press (obtained from Barbuto Design Co. of Dalton, Mass. under the trade designation Automatic Embedded Wire Press Serial No. 101589). The cavity depth was set at 10.5 millimeters, and the length and width of the cavity were 3.55 and 2.85 millimeters, respectively. The wire had a diameter of 0.24 millimeters and a length of 9.60 millimeters. The amount of flake used per anode was approximately 0.0428 grams and pressed to the dimensions of 3.58×2.93×0.60 millimeters with an average press density of 5.5 grams per cubic centimeter. The region of the anode just above and below the wire was pressed to 6.0 grams per cubic centimeters, which was caused by the embedded wire. The resulting anodes were sintered for 30 minutes at varying temperatures (i.e., 1300° C., 1335° C., 1350° C., 1410° C., and 1460° C.) and then anodized at varying voltages (i.e., 64, 80, and 100 volts). The resulting CV/g values are set forth below in Table 9.

TABLE 9

| | Specific Charge Values | | | | |
|---|---|---|---|---|---|
| Volts | 1300° C. | 1335° C. | 1350° C. | 1410° C. | 1460° C. |
| 64 | 16173 | 16244 | 15454 | 14698 | 13095 |
| 80 | 15641 | 15811 | 14556 | 13828 | 12460 |
| 100 | 14715 | 14809 | 13297 | 12748 | 11514 |

EXAMPLE 11

The ability to form capacitor anodes using the powder of Example 4 was demonstrated. The powder was mixed with a stearic acid (4 wt. %) binder, heated in an oven for 3.5 hours at 85° C., and then screened through a 300-micrometer sieve. The powder mixture was then manually loaded into the anode cavity of a side press (available from OPPC Co., Ltd. of Tokyo, Japan under the trade designation TAP-2R). The process settings were adjusted to the lowest speed and a maximum die opening so that the maximum possible pressed density was 5.0 grams per cubic centimeter. The pressed pellets were then vacuum sintered for 20 minutes at varying temperatures (i.e., 1500° C., 1550° C., and 1600° C.). The sintered density for the 1500° C. sintering temperature was 5.8 grams per cubic centimeter. The sintered pellets were then anodized at a voltage of 100 volts.

EXAMPLE 12

The ability to form capacitor anodes using the powder of Example 5 was demonstrated. The powder was mixed with a stearic acid (4 wt. %) binder, heated in an oven for 3.5 hours at 85° C., and then screened through a 300-micrometer sieve. The powder mixture was then manually loaded into the anode cavity of a side press (available from OPPC Co., Ltd. of Tokyo, Japan under the trade designation TAP-2R). The process settings were adjusted to the lowest speed and a maximum die opening so that the maximum possible pressed density was 4.5 grams per cubic centimeter. The pressed pellets were then vacuum sintered for 20 minutes at 1500° C. so that the sintered density was 4.8 grams per cubic centimeter. The sintered pellets were then anodized at a voltage of 100 volts.

Figure 11:
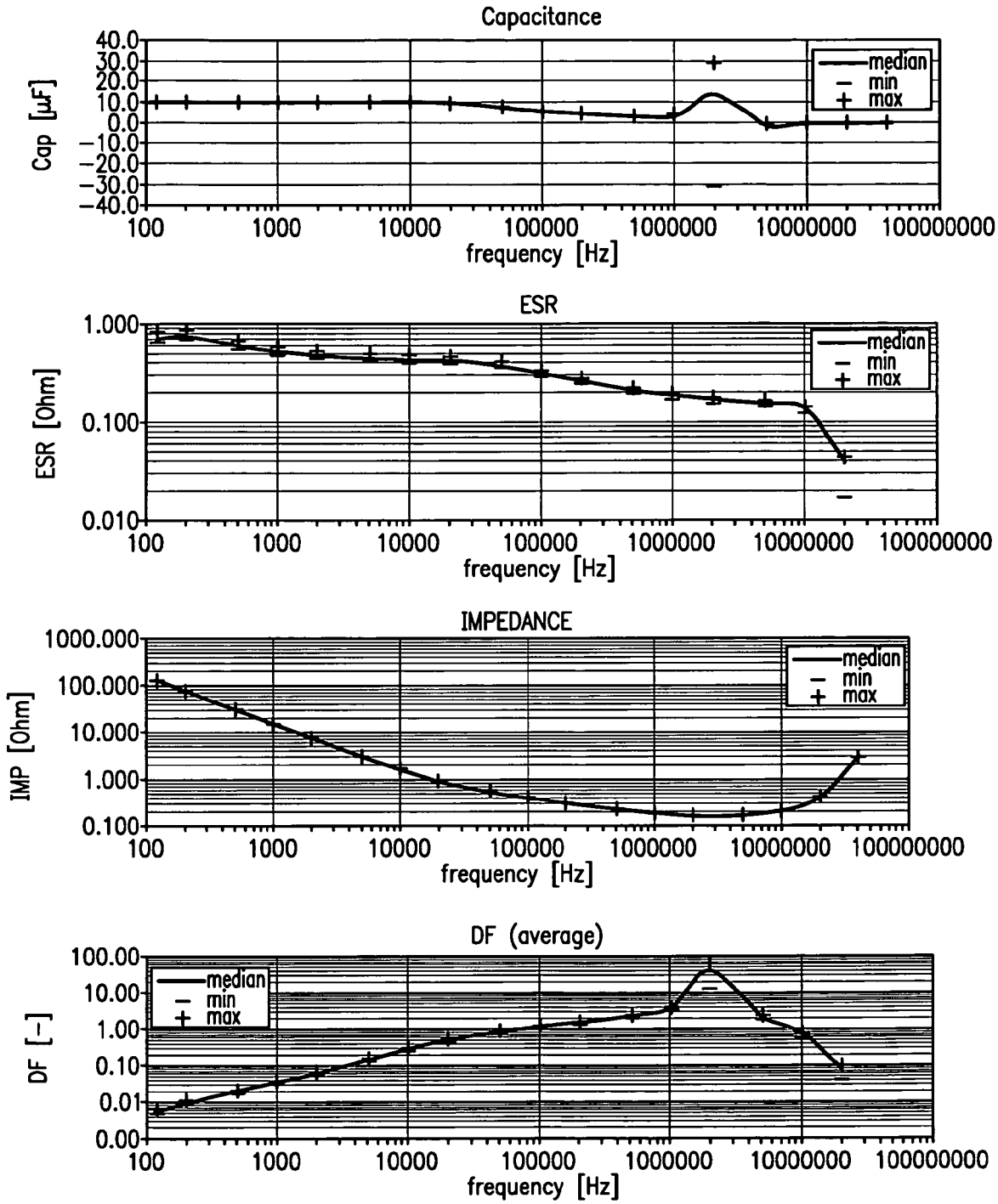
FIG. 11 illustrates the capacitance, impedance, dissipation factor, and ESR data obtained in Example 12 using the powder of Example 4.
Figure 12:
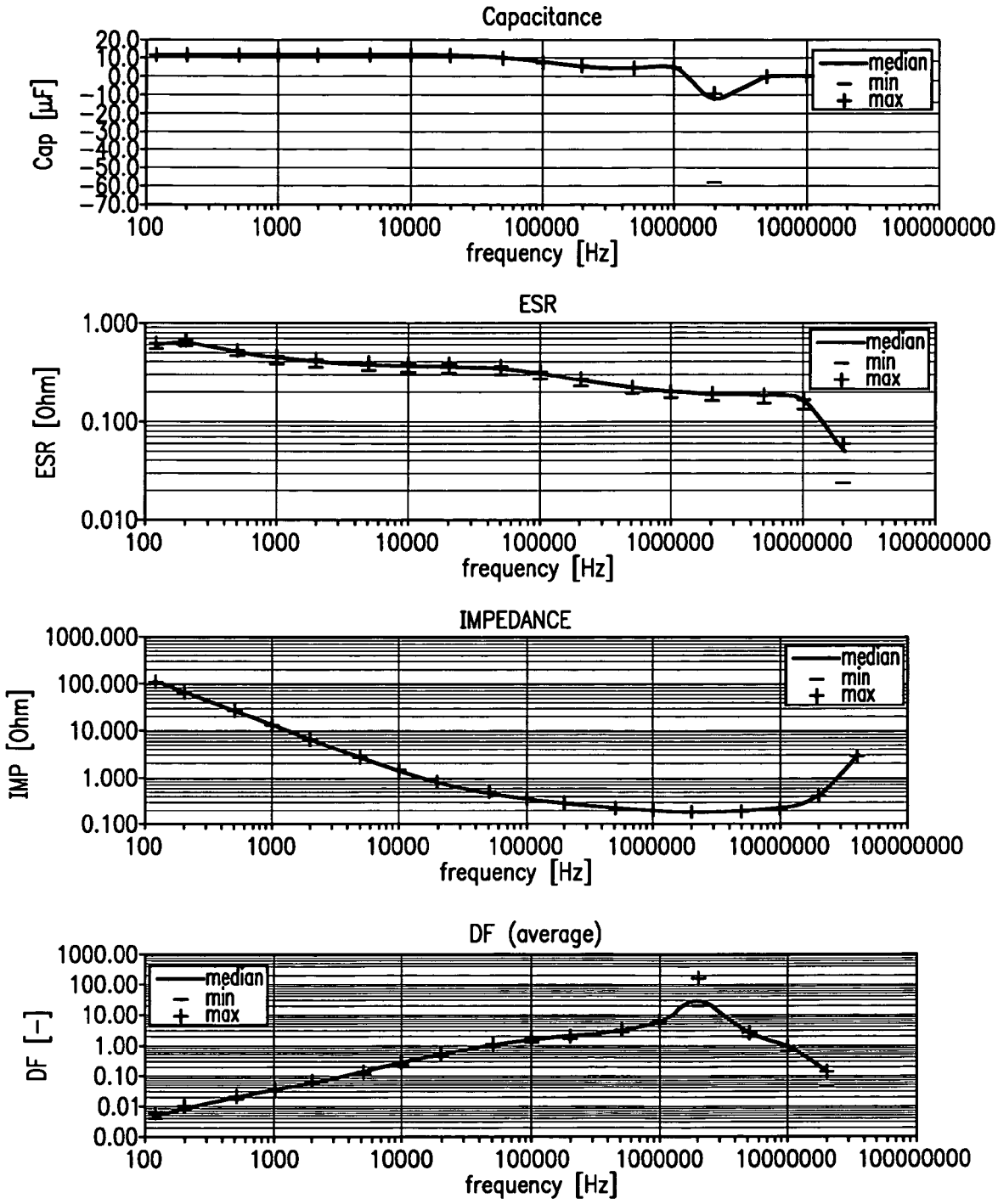
FIG. 12 illustrates the capacitance, impedance, dissipation factor, and ESR data obtained in Example 12 using a nodular tantalum powder obtained from H.C. Starck under the designation "VFI21 KT"
Figure 13:
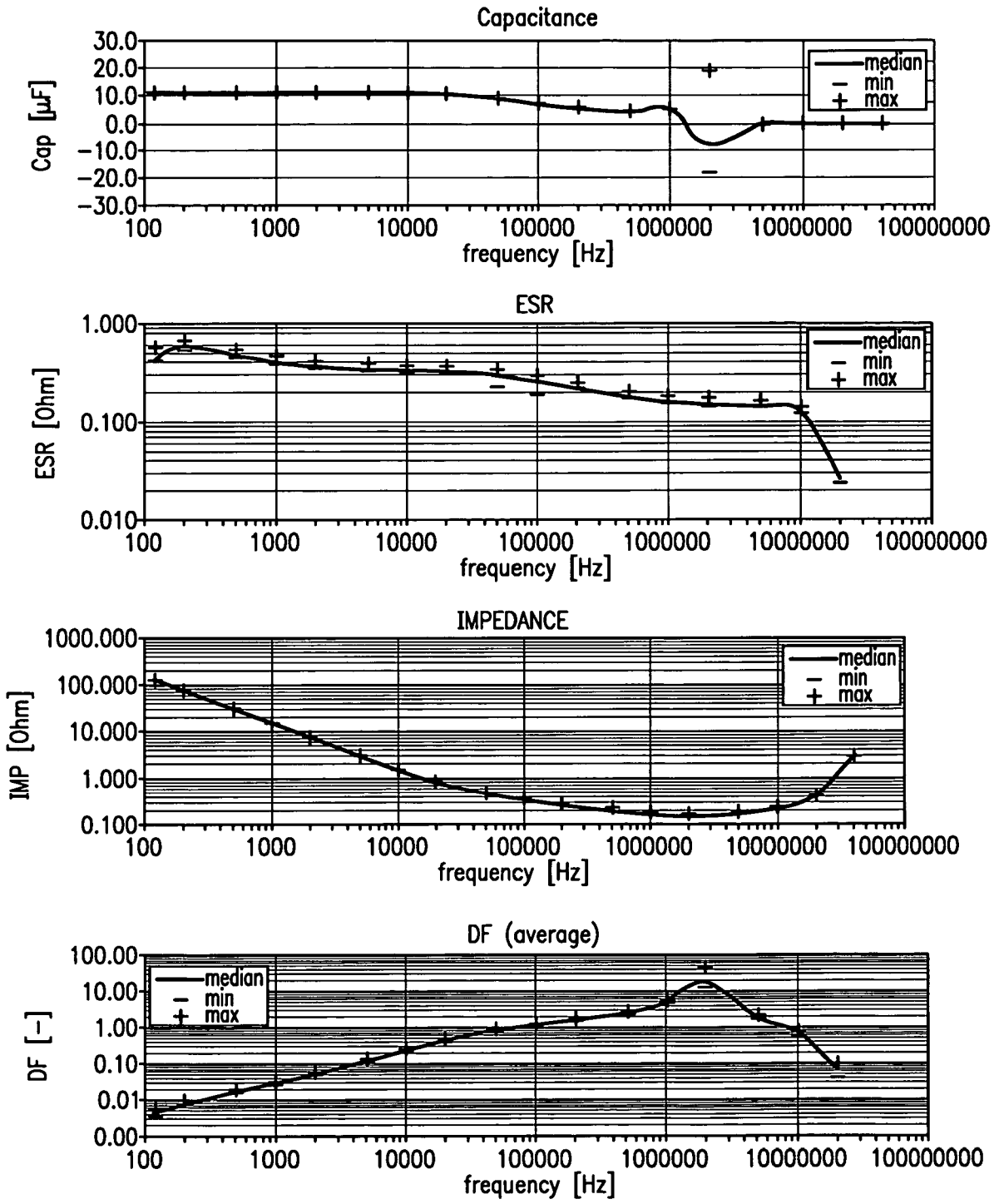
FIG. 13 illustrates the capacitance, impedance, dissipation factor, and ESR data obtained in Example 12 using a flake tantalum powder obtained from Cabot Corp. under the designation "C255."

Capacitors were also formed from a nodular tantalum powder (available from H.C. Starck under the designation "VFI21KT") and a flake tantalum powder (available from Cabot Corp. under the designation "C255"). All of the capacitors were then tested for capacitance, ESR, impedance, and DF (dissipation factor), all as a function of the excitation frequency. The results are shown in FIG. 11, FIG. 12 ("VF121KT" powder), and FIG. 13 ("C255" powder). As indicated, the powder formed according to the present invention had approximately the same electrical properties as other commercially available powders, despite the fact that it possessed a relatively low density and large particle size.

These and other modifications and variations of the present invention may be practiced by those of ordinary skill in the art, without departing from the spirit and scope of the present invention. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. An electrolytic capacitor comprising an anode that is formed from a tantalum powder that is milled and thereafter compressed into the shape of the anode, the milled powder containing flakes having a bulk density of from about 0.2 to 0.6 grams per cubic centimeter, a specific surface area of from about 0.5 to about 10 meters squared per gram, and an aspect ratio of from about 2 to about 400, wherein a wire having a longitudinal axis is embedded within the powder and the flakes are generally oriented in a direction of the longitudinal axis of the wire and disposed in close contact therewith, and wherein the electrolytic capacitor exhibits an equivalent series resistance ("ESR") of less than about 300 milliohms, measured with a 2-volt bias and 1-volt signal at a frequency of 2 MHz.

2. The electrolytic capacitor of claim 1, wherein the flakes have a specific surface area of from about 2.0 to about 4.0 meters squared per gram.

3. The electrolytic capacitor of claim 1, wherein the flakes have an aspect ratio of from about 10 to about 300.

4. The electrolytic capacitor of claim 1, wherein the flakes have a screen size distribution of at least about 60 mesh.

5. The electrolytic capacitor of claim 1, wherein the flakes have a screen size distribution of from about 60 mesh to about 325 mesh.

6. The electrolytic capacitor of claim 1, wherein the anode has a density of from about 4.5 to about 6 grams per cubic centimeter.

7. The electrolytic capacitor of claim 1, wherein the density of the anode is greater at a region adjacent to the anode wire than another region of the anode.

8. The electrolytic capacitor of claim 1, wherein the capacitor has an equivalent series resistance of less than about 200 milliohms at a frequency of 2 Megahertz.

9. The electrolytic capacitor of claim 1, wherein the capacitor has a dissipation factor of less than about 5% at a frequency of 2 Megahertz.

10. The electrolytic capacitor of claim 1, further comprising a dielectric overlying the anode.

11. The electrolytic capacitor of claim 10, further comprising a cathode overlying the dielectric layer.

12. The electrolytic capacitor of claim 11, wherein the cathode comprises one or more conductive polymers.

13. The electrolytic capacitor of claim 11, wherein the cathode comprises manganese dioxide.

* * * * *